US010463170B2

(12) United States Patent
Lange et al.

(10) Patent No.: US 10,463,170 B2
(45) Date of Patent: Nov. 5, 2019

(54) COLLAPSIBLE PLAY YARD

(71) Applicant: KIDS II, INC., Atlanta, GA (US)

(72) Inventors: Eric A. Lange, Alpharetta, GA (US); Chaitanya Tadipatri, Alpharetta, GA (US); Thomas M. Perrin, Alpharetta, GA (US)

(73) Assignee: KIDS II, INC., Atlanta, GA (US)

( * ) Notice: Subject to any disclaimer, the term of this patent is extended or adjusted under 35 U.S.C. 154(b) by 37 days.

(21) Appl. No.: 15/259,785

(22) Filed: Sep. 8, 2016

(65) Prior Publication Data

US 2017/0065100 A1 Mar. 9, 2017

Related U.S. Application Data

(60) Provisional application No. 62/215,908, filed on Sep. 9, 2015.

(51) Int. Cl.
*A47D 7/01* (2006.01)
*A47D 13/06* (2006.01)

(52) U.S. Cl.
CPC ..... *A47D 13/063* (2013.01)

(58) Field of Classification Search
CPC ..... A47D 13/06; A47D 7/01; A47D 9/00
USPC ..... 5/99.1, 101–102, 93.1
See application file for complete search history.

(56) References Cited

U.S. PATENT DOCUMENTS 1,039,986 A 10/1912 Merritt
1,041,147 A 10/1912 Murphy
1,183,819 A 5/1916 Keiser
1,968,340 A 7/1934 Glidden
2,059,058 A 10/1936 Swanson
2,189,567 A 2/1940 Miller
2,224,310 A 12/1940 Merrett et al.
2,287,907 A 6/1942 Schettler, Jr.
2,536,357 A 1/1951 David
2,586,247 A 2/1952 Mover
2,587,255 A 2/1952 Vogel et al.
2,624,054 A 1/1953 Plant
2,659,903 A 11/1953 Hagelfeldt
2,667,648 A 2/1954 Donovan
2,691,177 A 10/1954 Leonard
(Continued)

FOREIGN PATENT DOCUMENTS

CN 202515124 U 11/2012
WO 2014043653 A1 3/2014

OTHER PUBLICATIONS

European Search Report for EP App. No. 16188211.3; dated Jan. 27, 2017; 9 pgs.

*Primary Examiner* — Fredrick C Conley
(74) *Attorney, Agent, or Firm* — Gardner Groff & Greenwald, PC

(57) ABSTRACT

A collapsible play yard including a structural support frame, a liner attached to the frame and one or more folding systems. The structural support frame includes an upper frame and a plurality of leg members. The proximal end of each leg member attaches to the upper frame member which is the single point of contact between the leg member and the remainder of the frame. The collapsible play yard can include a first folding system to shorten the width of the play yard and a second folding system to shorten the height of the play yard. Each folding system can be folded and unfolded independent of the other.

20 Claims, 14 Drawing Sheets

(56) References Cited

U.S. PATENT DOCUMENTS 2,901,755 A 9/1959 Wood, Jr.
2,991,486 A 7/1961 Hamilton
2,992,441 A 7/1961 Landry
3,064,277 A 11/1962 Gill
3,103,670 A 9/1963 Landry
3,119,124 A 1/1964 Krauss
3,158,876 A 12/1964 Gottlieb
3,163,870 A 1/1965 Scotney, III
3,183,528 A 5/1965 Jacobs et al.
3,187,352 A 6/1965 Gottlieb
3,195,152 A 7/1965 Gottlieb
3,206,772 A 9/1965 Sarasin
3,225,407 A 12/1965 Daniels
3,309,718 A 3/1967 Sarasin
3,430,273 A 3/1969 Stillwaugh
3,474,472 A 10/1969 Hamilton, II
3,606,620 A 9/1971 Glover
3,631,548 A 1/1972 Dahab
3,655,297 A 4/1972 Bolen, Jr. et al.
3,709,454 A 1/1973 Hyde
3,789,439 A 2/1974 Berg et al.
3,799,228 A * 3/1974 Crawford ..... A45F 4/00 220/9.2
3,886,607 A 6/1975 Dunn
3,895,468 A 7/1975 Bernstein
3,910,339 A 10/1975 Kramer
3,924,280 A 12/1975 Vaiano
D244,890 S 7/1977 Adams
4,103,401 A 8/1978 Conley
4,202,065 A 5/1980 Sullivan
4,337,815 A 7/1982 Lindstrom
4,393,915 A 7/1983 Olson
4,455,697 A 6/1984 Rovida
4,493,120 A 1/1985 Watts
D281,745 S 12/1985 Pandorf et al.
4,611,945 A 9/1986 Diego
4,635,305 A 1/1987 Wyss
4,683,600 A 8/1987 Beger
4,819,285 A 4/1989 Fetters
4,837,875 A 6/1989 Shamie et al.
4,872,724 A 10/1989 Deley et al.
4,934,025 A 6/1990 Mariol
4,967,432 A 11/1990 Kujawski et al.
5,193,234 A 3/1993 Joaquin
5,211,498 A 5/1993 Huang
5,239,714 A 8/1993 Huang
5,241,716 A 9/1993 Kohus
5,269,587 A * 12/1993 Cunningham ..... A47D 1/02 297/16.1
5,293,656 A 3/1994 Chan
5,339,470 A 8/1994 Shamie
5,353,451 A 10/1994 Hsiung
5,358,220 A 10/1994 Yu-Kuang
5,367,725 A 11/1994 Tsai
5,381,570 A 1/1995 Cheng
5,454,124 A 10/1995 Huang
5,457,828 A 10/1995 Huang
5,474,404 A 12/1995 Chien
5,483,710 A 1/1996 Chan
5,485,655 A 1/1996 Wang
5,530,977 A 7/1996 Wang
5,533,215 A 7/1996 Malofsky et al.
5,553,336 A 9/1996 Mariol
5,560,055 A 10/1996 Ziegler
5,561,874 A 10/1996 Malofsky et al.
5,611,634 A 3/1997 Wang
5,727,265 A 3/1998 Ziegler et al.
5,730,542 A 3/1998 Cheng
5,745,954 A 5/1998 Shogan et al.
5,752,283 A 5/1998 Arens
5,761,754 A 6/1998 Cheng
5,761,755 A 6/1998 Huang
5,762,403 A 6/1998 Robinson
5,781,944 A 7/1998 Huang
5,803,650 A 9/1998 Wu
5,836,655 A 11/1998 Laufer
5,857,229 A 1/1999 Magnani, Jr.
5,964,545 A 10/1999 Cheng
5,978,987 A 11/1999 Wang
5,988,928 A 11/1999 Cheng
5,992,348 A 11/1999 Harding
6,018,846 A 2/2000 Huang
6,082,922 A 7/2000 Cheng
6,125,483 A 10/2000 Stroud et al.
6,148,488 A 11/2000 Gristock
6,202,229 B1 3/2001 Cheng
6,223,366 B1 5/2001 Cheng
6,233,759 B1 5/2001 Warner, Jr. et al.
6,250,837 B1 6/2001 Mariol et al.
6,263,525 B1 7/2001 Liu
6,343,390 B1 2/2002 Yang et al.
6,363,550 B1 4/2002 Wang
6,364,563 B1 4/2002 Cheng
6,375,269 B1 4/2002 Maeda et al.
6,385,800 B1 5/2002 Chen et al.
6,421,850 B1 7/2002 Welsh, Jr.
6,470,515 B1 10/2002 Hsia
6,474,021 B2 11/2002 Homeyer
6,510,568 B1 1/2003 Drobinski et al.
6,560,827 B1 5/2003 Gross
6,634,038 B2 10/2003 Hsia
6,634,039 B1 10/2003 Cheng
6,729,791 B1 5/2004 Chen
6,735,796 B2 5/2004 Warner, Jr. et al.
6,817,046 B1 11/2004 Srour et al.
6,851,135 B1 2/2005 Chen
6,859,957 B1 3/2005 Chen
6,915,545 B2 7/2005 Chen
7,043,779 B2 5/2006 Mendenhall et al.
7,090,201 B2 8/2006 Brucker
7,108,443 B2 9/2006 Chen
D550,003 S 9/2007 Fiore, Jr. et al.
7,284,288 B2 10/2007 Cheng
7,380,311 B2 6/2008 Chen
7,418,745 B2 9/2008 Paesang et al.
7,448,098 B2 11/2008 Cheng
7,526,821 B2 5/2009 Chen et al.
D594,237 S 6/2009 Gower et al.
7,568,242 B2 8/2009 Troutman
7,614,097 B1 11/2009 Cheng
D619,816 S 7/2010 Chen
7,752,688 B2 7/2010 Chen et al.
7,818,832 B2 10/2010 Hartenstine et al.
7,836,530 B2 11/2010 Thorne et al.
7,930,776 B2 2/2011 Jackson et al.
7,882,579 B2 4/2011 Chen et al.
7,937,786 B2 5/2011 Bergkvist
7,958,578 B2 6/2011 Shan et al.
7,958,601 B2 6/2011 Yu et al.
8,001,630 B2 8/2011 Burkholder et al.
8,006,326 B2 8/2011 Thomas et al.
8,060,959 B2 11/2011 Thorne et al.
8,069,533 B2 12/2011 Yu et al.
8,141,186 B2 3/2012 Burns et al.
8,201,291 B2 6/2012 Burns et al.
D666,848 S 9/2012 Longenecker et al.
8,291,530 B2 10/2012 Burkholder et al.
8,316,483 B2 11/2012 Thomas et al.
RE43,919 E 1/2013 Chen
8,365,323 B2 2/2013 Crumrine
D680,760 S 4/2013 Hsu
8,458,828 B2 6/2013 Lake
8,458,829 B2 6/2013 Thorne et al.
8,490,227 B2 7/2013 Troutman
8,523,283 B2 9/2013 Lee
8,550,565 B2 10/2013 Caldwell
8,607,379 B2 12/2013 Yoshie et al.
8,635,721 B2 1/2014 Zhang
8,756,727 B2 6/2014 Thorne et al.
8,806,673 B2 8/2014 Burkholder et al.
8,943,622 B2 2/2015 Saint et al.
8,997,277 B2 4/2015 Thomas et al.
D728,984 S 5/2015 Westin et al.
9,027,180 B2 5/2015 Troutman

(56) References Cited

U.S. PATENT DOCUMENTS

| | | | |
|---|---|---|---|
| 9,066,607 | B1 | 6/2015 | Ransil et al. |
| 9,103,368 | B2 | 8/2015 | Mendes et al. |
| 9,149,128 | B2 | 10/2015 | Rampton et al. |
| 9,301,624 | B2 | 4/2016 | Rosenthal et al. |
| 9,314,115 | B2 | 4/2016 | Troutman |
| 9,332,860 | B2 | 5/2016 | Rong et al. |
| 9,414,694 | B2 | 8/2016 | Arnold, IV et al. |
| 2001/0001162 | A1 | 5/2001 | Warner, Jr. et al. |
| 2001/0001330 | A1 | 5/2001 | Warner, Jr. et al. |
| 2002/0138900 | A1 | 10/2002 | Hu |
| 2003/0154547 | A1 | 8/2003 | Hsia |
| 2003/0177575 | A1 | 9/2003 | Cheng et al. |
| 2005/0262629 | A1 | 12/2005 | Cheng et al. |
| 2006/0000019 | A1 | 1/2006 | Martin |
| 2006/0021136 | A1 | 2/2006 | Cheng |
| 2006/0174406 | A1 | 8/2006 | Yang |
| 2006/0225207 | A1 | 10/2006 | Johnson |
| 2006/0225208 | A1 | 10/2006 | Chen |
| 2006/0230528 | A1 | 10/2006 | Church |
| 2007/0017025 | A1 | 1/2007 | Myer |
| 2007/0101493 | A1 | 5/2007 | Campbell et al. |
| 2007/0163041 | A1 | 7/2007 | Cheng et al. |
| 2007/0214605 | A1 | 9/2007 | Tu |
| 2007/0271697 | A1 | 11/2007 | Martin |
| 2008/0127412 | A1 | 6/2008 | Pleiman et al. |
| 2009/0077742 | A1 | 3/2009 | Burns et al. |
| 2009/0077775 | A1 | 3/2009 | Burns et al. |
| 2009/0172879 | A1 | 7/2009 | Hsu |
| 2010/0132115 | A1 | 6/2010 | Hsu |
| 2010/0138991 | A1 | 6/2010 | Hartenstine et al. |
| 2011/0085847 | A1 | 4/2011 | Anderson |
| 2011/0229251 | A1 | 9/2011 | Yeh |
| 2012/0012801 | A1 | 1/2012 | Burns et al. |
| 2012/0036634 | A1 | 2/2012 | Pacella |
| 2013/0133136 | A1 | 5/2013 | Cheng |
| 2013/0205496 | A1 | 8/2013 | Cheng |
| 2013/0239382 | A1 | 9/2013 | Cheng |
| 2013/0333111 | A1 | 12/2013 | Cheng |
| 2014/0047639 | A1 | 2/2014 | Cheng |
| 2014/0075670 | A1* | 3/2014 | Crumrine ..... A23C 9/1322 5/99.1 |
| 2014/0283298 | A1 | 9/2014 | Cheng |
| 2015/0164240 | A1 | 6/2015 | Thomas et al. |
| 2015/0196135 | A1 | 7/2015 | Longenecker et al. |
| 2015/0216322 | A1* | 8/2015 | Longenecker ..... A47D 9/005 5/99.1 |
| 2016/0183698 | A1 | 6/2016 | Szymanski et al. |

* cited by examiner

COLLAPSIBLE PLAY YARD

CROSS-REFERENCE TO RELATED APPLICATION

This application claims the benefit of U.S. Provisional Patent Application Ser. No. 62/215,908 filed Sep. 9, 2015, the entirety of which is hereby incorporated herein by reference for all purposes.

TECHNICAL FIELD

The present invention relates generally to the field of children's accessories, and more particularly to child containment devices such as portable play yards.

BACKGROUND

Play yards are often used by parents and caregivers to provide a partially contained space for an infant child to rest and play. Typically, play yards include a structural frame having vertical corner post frame members joined by upper and lower horizontal frame cross-members forming a rectangular frame enclosure. A floor panel and sidewalls are commonly attached to the frame members to form an enclosed space with an upper opening through which a child may be placed in and moved out of the play yard. The sidewalls and floor panel are often comprised of a fabric or soft-goods material attached onto the frame members. In some instances, the frame members may be collapsible or hinged, such that the play yard can be folded or collapsed into a more compact configuration to allow for easier portability and storage of the play yard when not in use.

Previously known play yards typically include lower horizontal frame members or lower cross members at or near the bottom of the frame enclosure. These lower members increase the overall weight of the play yard, but have heretofore been considered part of a standard play yard frame configuration for providing desired structural stability and integrity. Further, set-up and take-down of typical play yards known in the art usually require an adult caregiver to carry out a series of steps that must be completed in a prescribed order to properly set up and fold the play yard.

The weight and complicated set-up of many known play yards may render the play yards onerous for parents and caregivers. Additionally, the configurations of many known play yards may make access to the contained space difficult for some adult caregivers. Accordingly, it can be seen that needs exist for continuing improvements to the field of child containment devices such as children's play yard devices. It is to the provision of improved child containment devices and children's play yards meeting these and other needs that the present invention is primarily directed.

SUMMARY

In example embodiments, the present invention provides improved child containment devices and children's play yards that provide ease of use for the adult caregiver, and a secure and comfortable play area for children. In example embodiments, the children's play yard incorporates a lightweight frame which is easily set up and taken down, and which is configured for improved ease of access by adult caregivers.

In one aspect, the present invention relates to a child containment device including a frame having a plurality of support legs, each support leg having an upper end and a lower end. The frame preferably also includes a plurality of frame cross members extending between upper ends of the support legs, with the lower ends of the support legs being unconnected by the frame. The child containment device preferably also includes a liner configured for attachment to the frame to define a contained space therein.

In another aspect, the invention relates to a child containment device including a frame and a liner. The frame preferably includes a plurality of support legs, each support leg having an upper end and a lower end, and a plurality of frame cross members extending between upper ends of the support legs. The frame preferably defines a frusto-pyramidal three-dimensional assembly having a relatively larger base periphery defined by the lower ends of the support legs and a relatively smaller upper periphery defined by the frame cross members. The liner is preferably configured for attachment to the frame to define a contained space therein.

In still another aspect, the invention relates to a child containment device including a frame having a plurality of support legs, each support leg having an upper end and a lower end. The frame preferably also includes a plurality of frame cross members extending between upper ends of the support legs. The child containment device preferably also includes a liner configured for attachment to the frame to define a contained space therein. A front end of the child containment device has a front elevation, and a back end of the child containment device has a back elevation, and the back elevation is preferably greater than the front elevation.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

Figure 2:
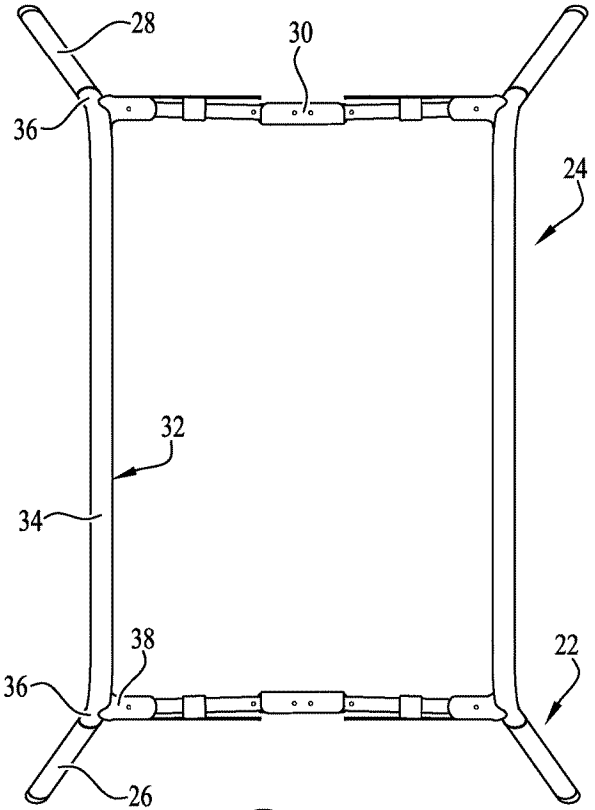
FIG. 2 is a top view of the collapsible play yard frame of FIG. 1.
Figure 1:
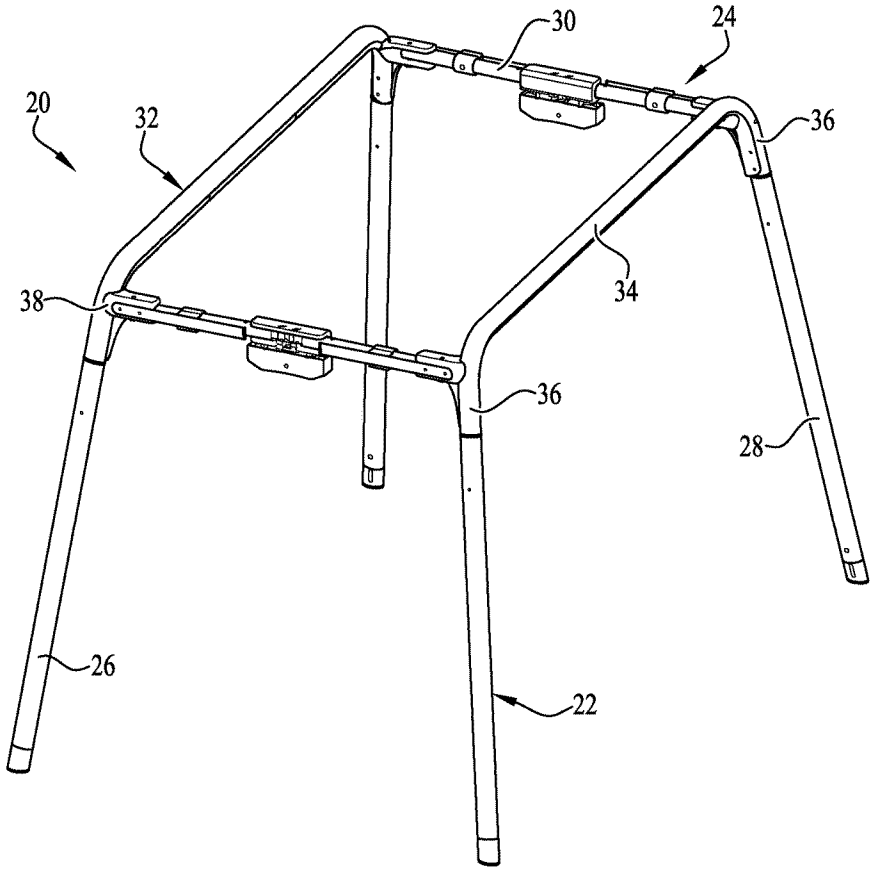
FIG. 1 is a perspective view of a collapsible play yard frame according to an example embodiment of the present invention.

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-24 show a collapsible play yard 10 for providing an enclosed space for a child to play and rest. Generally, the collapsible play yard includes a structural support frame 20 configured to rest on a support surface S, a liner 40 attached to the frame and one or more folding systems. The play yard frame 20 is a substantially rigid structure configured for engaging and supporting the liner 40, which is preferably constructed from soft goods such as a fabric or other flexible material. When in a use position, the frame 20 and liner 40 define a partially enclosed space dimensioned for receiving a child and providing a comfortable space for the child to play and rest. Example embodiments of the present invention also include a detachable mattress 120 and other detachable accessories, examples including an inclined sleeper 130.

FIGS. 1-4 illustrate the play yard frame 20 according to example embodiment of the present invention. The support frame 20 is shown without the liner for better visibility of the frame elements, in an expanded or unfolded configuration for use. The frame 20 includes four generally upright and inclined corner posts or leg members 22 and a plurality of upper frame cross members 24, forming a generally rectangular, three-dimensional housing bounding an internal contained volume or space for structurally supporting the liner to define a contained space for receiving a child therein. The leg members generally include two front leg members 26 and two back leg members 28. The upper frame includes first and second upper end cross-members 30, and first and second upper side cross-members 32. The upper frame 24 forms a rectangular upper opening generally in the shape of rectangle or quadrangle. In the depicted embodiment, the side cross-members 32 are longer than the end cross-members 30, defining a containment having a length greater than its width. In alternate embodiments, the length and width may be generally equal, or the width may be greater than the length. In example embodiments, the frame 20 is constructed of hollow aluminum tubing with acrylonitrile butadiene styrene components. In other embodiments, the frame 20 is constructed of aluminum, steel, plastic or any other suitably rigid structural material. In the depicted embodiment, the frame members have an elliptical cross-sectional shape for improved stiffness in the direction of typical loading during use, to resist bending or twisting of the hinge couplings, and to assist in attachment of the liner as described in further detail below. In alternate embodiments, the frame 20 members can have a round, oval, square, rectangular or other cross-sectional shape(s).

Figure 3:
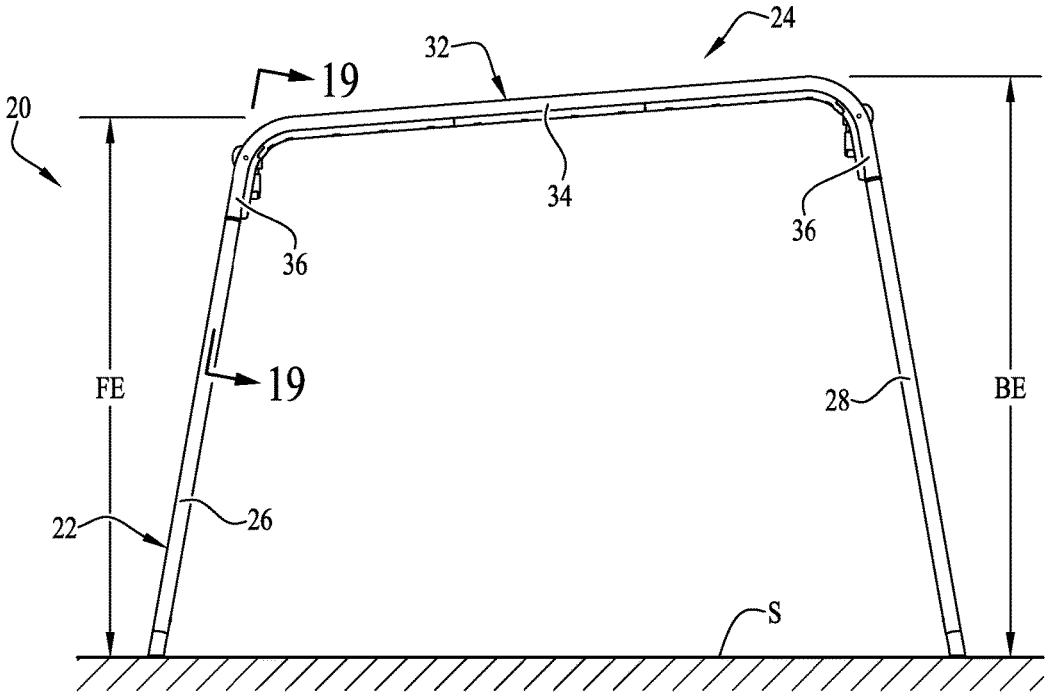
FIG. 3 is a side view of the collapsible play yard frame of FIG. 1.
Figure 4:
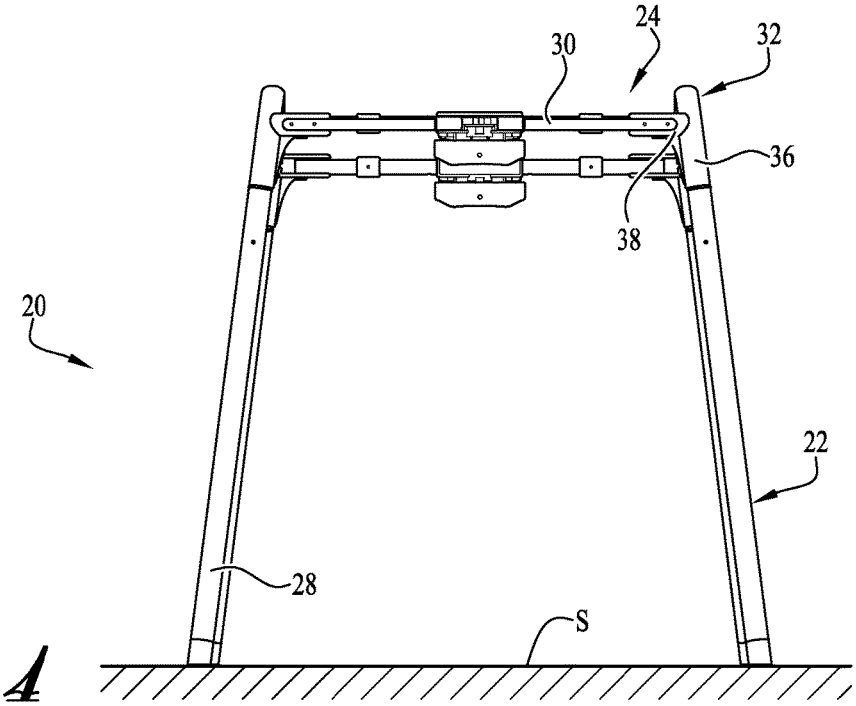
FIG. 4 is an end view of the collapsible play yard frame of FIG. 1.

As shown in FIG. 3, the side cross-members 32 are generally U-shaped, having an upper bar 34 and two end bars 36 extending from opposite ends of the upper bar and having angled or arcuate transitions therebetween. The upper bar 34 defines the length of the play yard 10. In alternate embodiments, the side cross-members comprise one or more coupled segments. As shown in FIG. 4, the side cross-members 32 include two attachments 38 for receiving each of the end cross-members 30. In the example embodiment, attachments 38 are positioned at the proximal end of the end bars 36. The end cross-members 30 are attached at a first end to the first side cross-member 32 and at a second end to the second side cross-member. The end cross-members 30 define the width of the play yard 10. The distal end of each end bar 36 attaches to the proximal end of a leg member 22. In the depicted embodiment, the end cross-members 30 and the side cross members 32 are attached between corresponding adjacent leg members 22 at or adjacent the proximal or upper ends of the leg members, and the lower or distal ends of the leg members are free of any connection (i.e., not attached to) any other frame elements. The leg members 22 define the height of the play yard 10. In the example embodiment, the attachment between the side-cross member 32 and the leg member 22 is the single point of contact for each leg member to the upper frame 24. In preferred embodiments, the play yard frame 20 does not include a member or support between leg members 22 at the distal or lower ends of the leg supports or at a point between the top or proximal end and the distal or lower end.

In the example embodiment, each end bar 36 and attached leg member 22 is positioned such that the leg member forms an obtuse angle relative to the upper bar 34, for example between about 95° to about 120°. When assembled for use, the distal ends or feet of the leg members 22 rest on a floor or other support surface S. In the example embodiment, the leg members 22 are positioned such that the leg members form an acute angle relative to the support surface S, for example between around 70° and 90°. In alternate embodiments, the side cross-members 32 and leg members 22 are positioned such that the leg members are substantially vertical relative to the support surface S and perpendicular relative to the upper bar 34. In the depicted embodiment, the erected frame defines an upwardly and inwardly inclined generally frusto-pyramidal (i.e., a rectangular right frustum or truncation of a rectangular pyramid) three-dimensional assembly having a relatively larger rectangular base footprint or periphery defined by the lower ends or feet of the leg members 22, and a relatively smaller rectangular upper periphery defined by the end cross members 30 and the side cross members 32. The structure of the frame 20 including the leg members 22 being outwardly inclined toward their lower ends provides a stable base structure and supports forces or loads applied by a child within the play yard during use, without the additional weight and complexity of lower cross members as found in many previously known play yard devices.

In the depicted embodiment of the play yard frame 20, the front elevation FE is shorter than the back elevation BE, as shown in FIG. 3, with the side cross members 32 being upwardly inclined from front to back. The difference in height helps define a direction to the play yard 10, giving the play yard a lower front end and a higher back end. The higher back elevation BE may facilitate the attachment of accessories or modular systems at a desired working height for an adult caregiver, and the lower front elevation FE may improve accessibility to the child by a caregiver making it easier to place and remove a child into and from the contained area of the play yard 10. Examples of accessories and modular systems are shown in U.S. patent application Ser. No. 15/189,083, which is incorporated herein by reference, and can include for example a bassinet, changing table, sleeper unit, storage containment, or other accessories configured for attachment to the play yard frame 20. In example embodiments, the front elevation FE is generally between about 26 inches and about 32 inches, and the back elevation BE is about 2-4 inches taller than the front elevation FE such that the back elevation BE is between about 28 inches and about 36 inches, for example about 34 inches. In the example embodiment, the height of the various leg members 22 creates the difference between the front elevation FE and the back elevation BE. The length of the back leg members 28 is, for example, about 10% greater than the length of the front leg members 24. In alternative embodiments, the difference in elevation is facilitated by adjusting the length the end bars 36 of the side-cross members 32 or adjusting the angle of the end bars relative to the upper bar 34. In alternate embodiments, the front elevation FE and the back elevation BE are equal or approximately equal, and the upper bars 34 of the side cross-members 32 are generally parallel with the support surface S.

Figure 5:
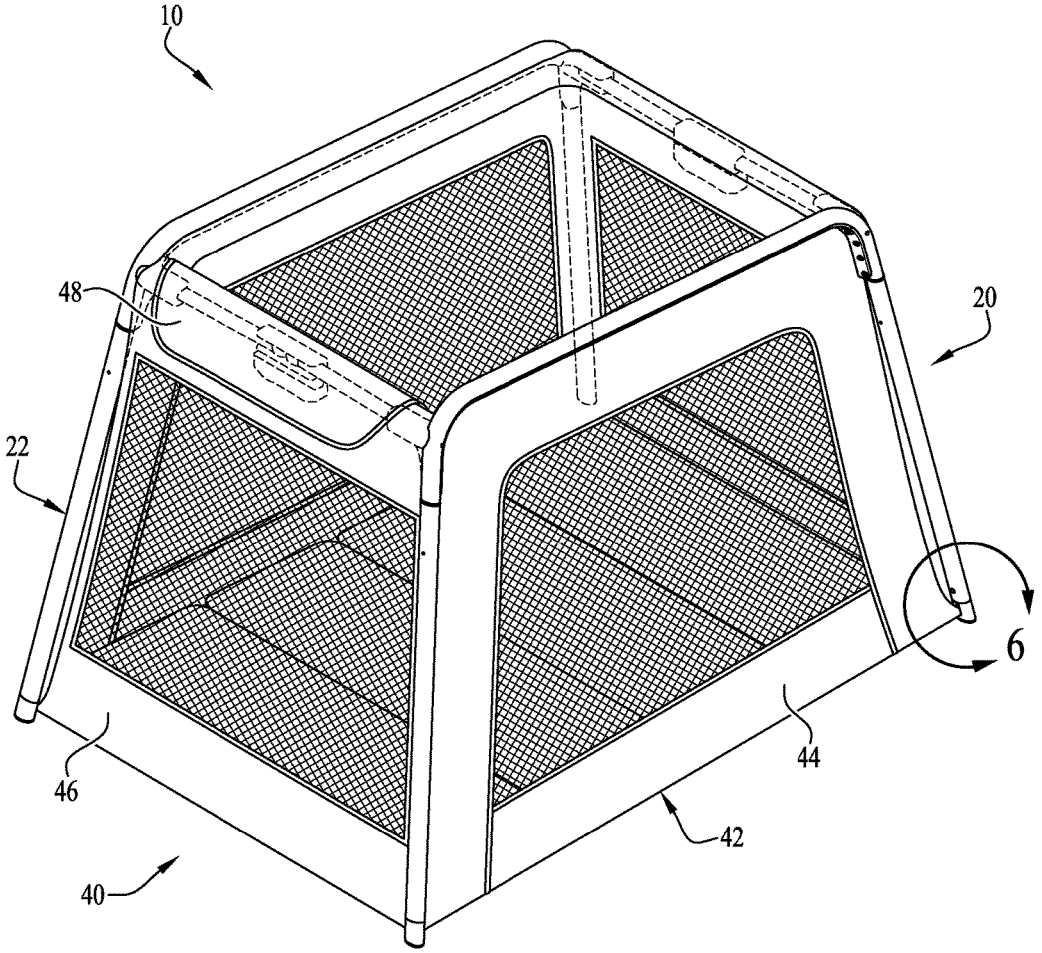
FIG. 5 is a perspective view of a collapsible play yard according to an example embodiment of the present invention.
Figure 6:
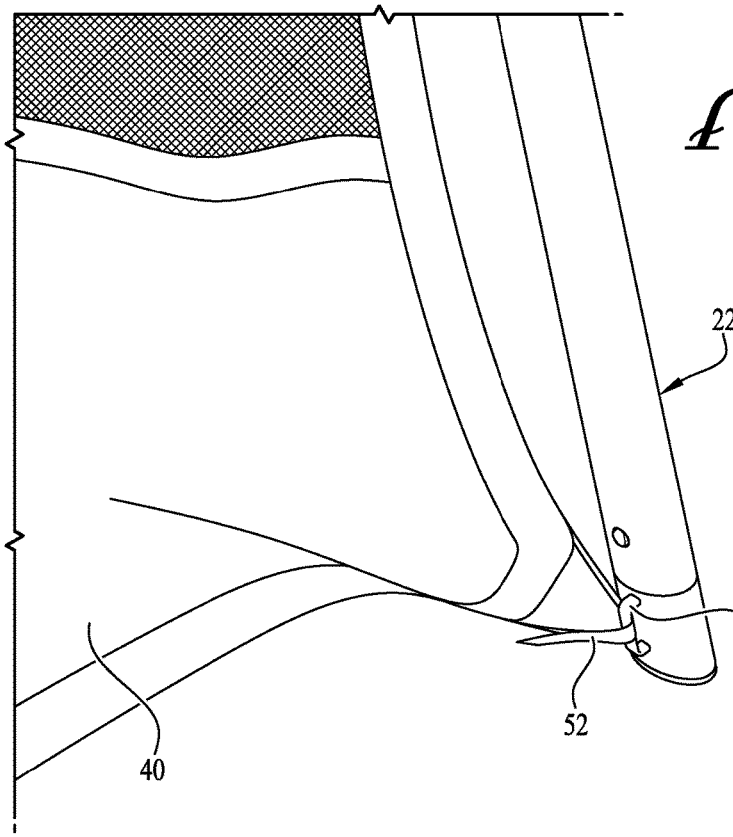
FIG. 6 shows a detailed view of a lower corner portion of the collapsible play yard of FIG. 5.

FIGS. 5-8 show a collapsible play yard 10 of the present invention, including the structural support frame 20 and an attached liner 40. The liner 40 generally includes a rectangular base or floor panel 42, first and second trapezoidal or generally rectangular side wall panels 44, and first and second trapezoidal or generally rectangular end wall panels 46. The liner 40 optionally includes top flaps 48 comprising an extension of at least a portion of one or more of the side wall panels 44 and/or the end wall panels 46 of the liner 40. In example embodiments, the top flaps 48 are an extension of the end walls 46 of the liner 40. The size and shape of the floor 42 and wall panels 44, 46 of the liner 40 are configured to generally conform to the size and shape of the frame 20 of the play yard 10, whereby the liner fits closely within the leg members 22 of the frame in its expanded configuration, as shown in FIG. 5, with the side wall panels and the end wall panels of the liner extending between and interior of the leg members of the frame. In example embodiments, the liner 40 optionally provides further structural support to the frame 20, for example limiting the outward expansion of the leg members 22 by tension applied along the wall panels 44, 46 as the frame is erected and as forces may be applied to the liner by a child within the play yard. The liner 40 can be constructed of polyester, nylon, cotton or other natural or synthetic fabric or other flexible material. The liner 40 optionally includes one or more panels of mesh or other materials providing visibility and breathability through the liner. In example embodiments, the liner is configured for substantially permanent attachment to the frame. In alternate embodiments, the liner 40 is configured for ease of removal from the frame 20, for example to clean and replace the liner in ordinary usage of the play yard.

In example embodiments, the liner 40 is attached to the distal ends of the leg members 22 and at least a portion of the upper frame 24. In the embodiment depicted in FIG. 6, each of the four bottom corners of the liner 40 is attached to a distal end or foot of a leg member 22. In example embodiments, the foot of each leg member 22 includes an attachment loop or hole 50 and the liner includes an attachment strap 52. The corner of the liner 40 is secured to the foot of the leg member 22 by feeding the end of the strap 52 through the attachment loop 50 and securing the end of the strap to the liner. The end of the strap 52 can be secured to the liner 40 by hook-and-loop attachment material, zipper, snaps, buttons, ties, buckles or other attachment means. In alternative embodiments, the liner 40 can comprise an attachment loop or hole and the foot of the leg member 22 can comprise the strap. Alternatively, the liner can include pockets on the outer corners configured to receive and retain the distal ends of the leg members. In other embodiments, the liner is attached at multiple points, or continuously, along the leg members.

Figure 7:
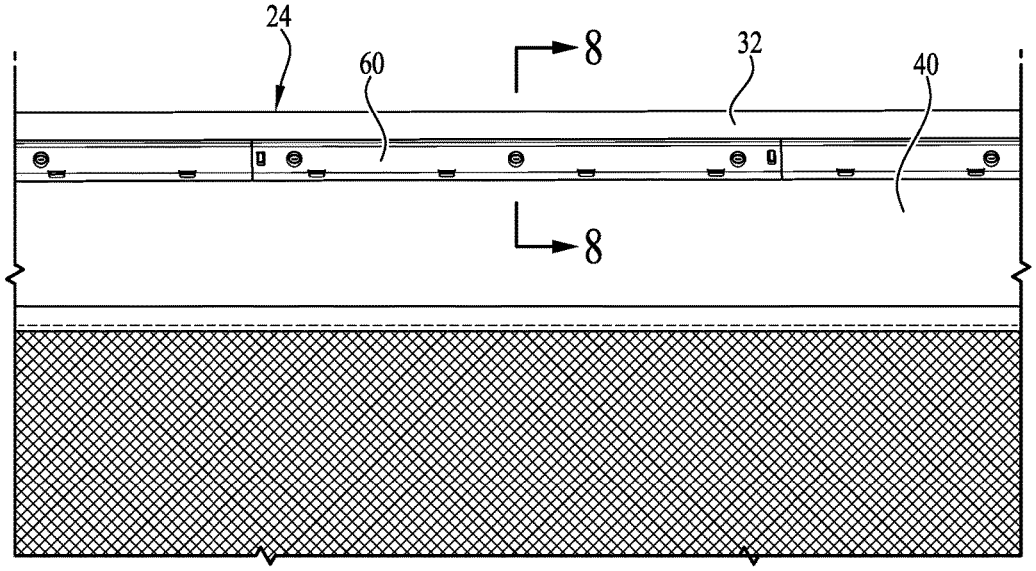
FIG. 7 shows a liner attachment assembly of the collapsible play yard of FIG. 5.
Figure 8:
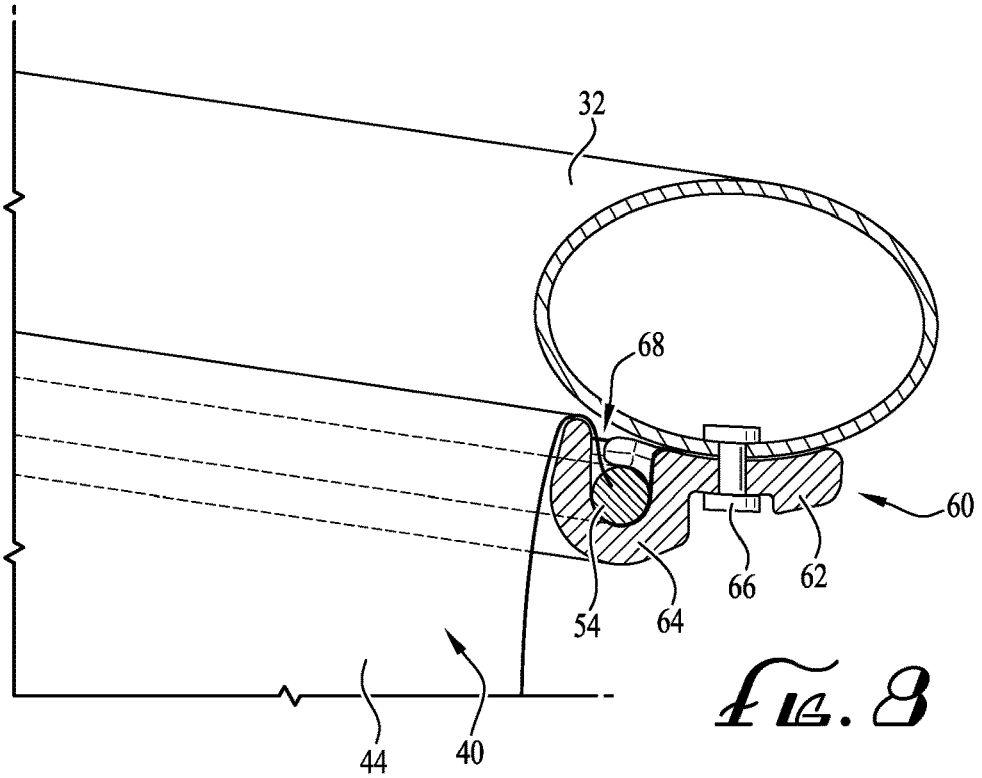
FIG. 8 shows a cross sectional view of the liner attachment of FIG. 7.

In example embodiments, the liner 40 is further coupled to at least a portion of the upper frame 24 by a liner attachment assembly. For example, in the depicted embodiment, the upper peripheries of the side walls 44 of the liner are coupled to the side cross-members 32. Each side cross-member 32 includes a liner coupling member 60 extending along at least a portion of the side cross-member, designed to receive and retain at least a portion of the liner 40, as shown in FIGS. 7 and 8. The corresponding upper periphery of the liner's side wall 44 includes a male rod 54. The coupling member 60 includes an attachment flange 62 and a female channel portion 64. The attachment flange 62 is configured to abut and attach to the bottom of the side cross-member 32. The attachment flange 62 can be affixed to the side cross-member 32 using screws 66, glue, or any other attachment method. The female channel portion 64 includes a female channel 68 with a slot small enough to retain the liner rod 54 and large enough to allow the liner 40 fabric to pass through. The liner rod 54 can be sewn, glued, or otherwise affixed to the side wall 44 of the liner 40. To assemble the play yard 10, the liner rod 54 is fed into the female channel 68 and the side wall 44 of the liner 40 extends out of the slot in the female channel 68. In alternate embodiments, the liner 40 is attached to the end cross-members 30 or a combination of both the end cross-members and the side-cross members 32.

Figure 9:
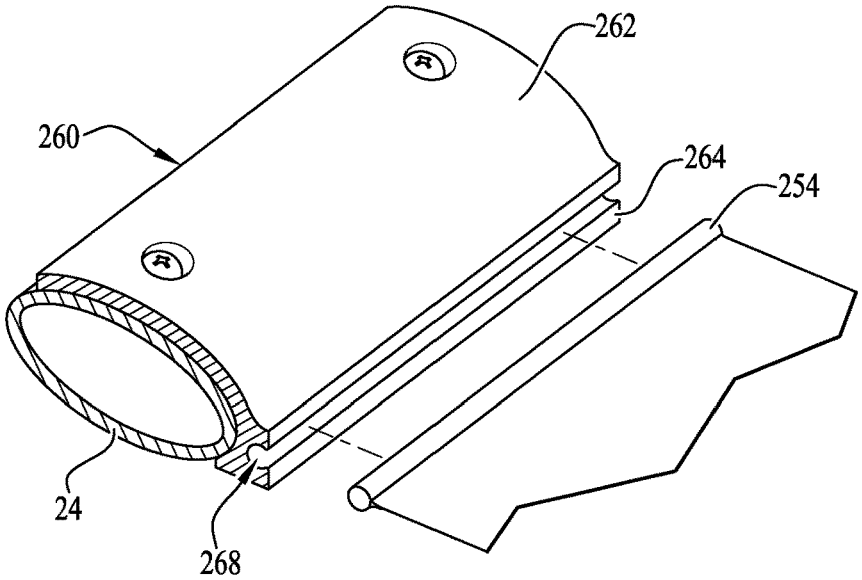
FIG. 9 shows a liner attachment assembly for a play yard according to another example embodiment of the present invention.

FIG. 9 depicts a liner attachment assembly having a coupling member 260 according to another example embodiment of the present invention. The coupling member 260 includes an attachment flange 262 and a female channel portion 264 similar to the previous embodiment. However, in the present embodiment, the attachment flange 262 abuts and attaches to the top of the upper frame member 24. Further, the female channel 268 is configured such a sufficient portion of the channel is exposed to allow the liner rod 254 to snap fit into the female channel.

Figure 10:
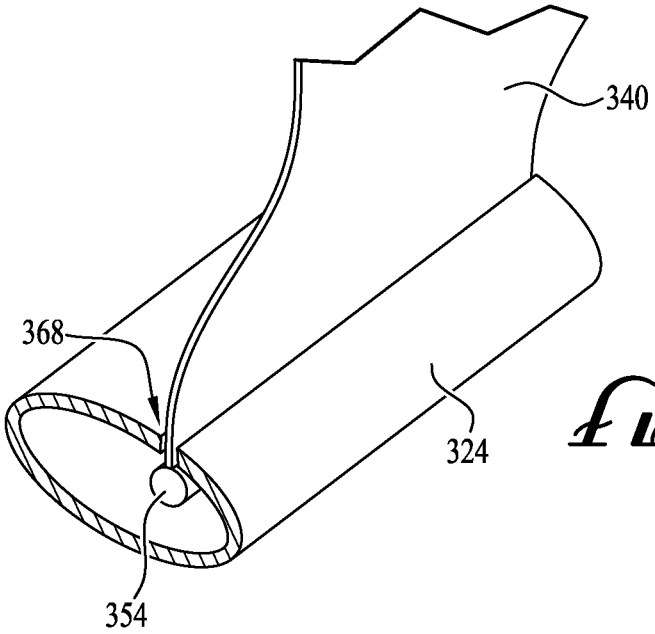
FIG. 10 shows a liner attachment assembly for a play yard according to another example embodiment of the present invention.
Figure 11:
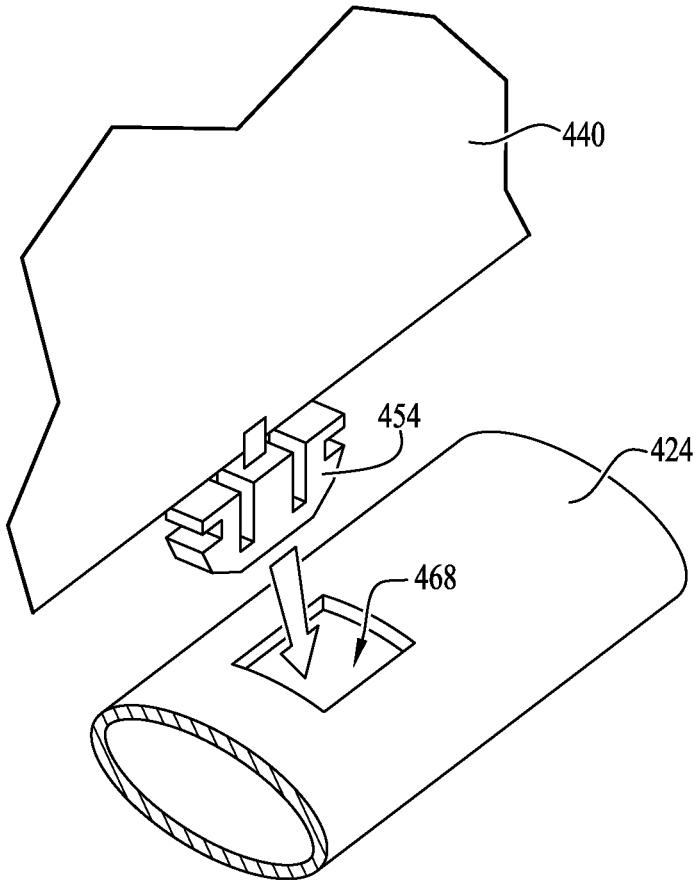
FIG. 11 shows a liner attachment assembly for a play yard according to another example embodiment of the present invention.

FIGS. 10 and 11 depict alternative liner attachment assemblies having upper frame members configured to receive the liner directly. In the embodiment depicted in FIG. 10, the liner 340 includes a male rod 354, similar to the above described embodiments. The hollow upper frame member 324 includes a slot small 368 enough to retain the liner rod 354, but large enough to allow the wall of the liner 340 to pass through. To attach the liner 340, the liner rod 354 is inserted into the hollow frame member 324 such that the liner 340 passes through the slot 368. In the embodiment depicted in FIG. 11, the upper edge of the liner 440 includes one or more tab members 454. The tab member 454 can be sewn, glued or otherwise permanently attached to the liner 440. In the depicted embodiment, the upper frame member 424 includes one or more apertures 468 configured to receive and retain the tab member 454. Each tab member 454 is snap fitted or otherwise attached to each aperture 468 to attach the liner 440 to the upper frame 424.

Figure 12:
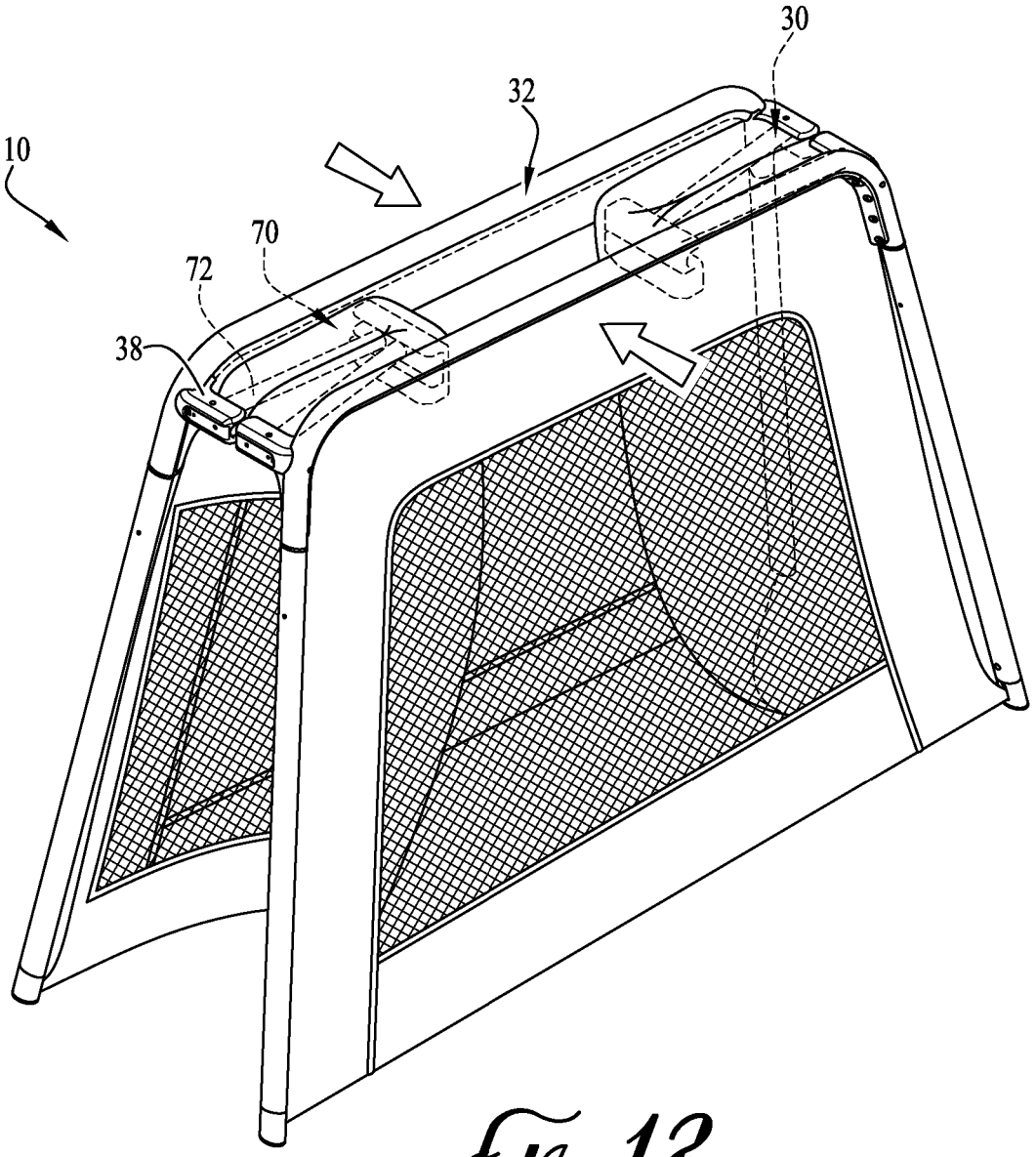
FIG. 12 is a perspective view of the collapsible play yard in a partially folded configuration according to an example embodiment of the present invention.
Figure 13:
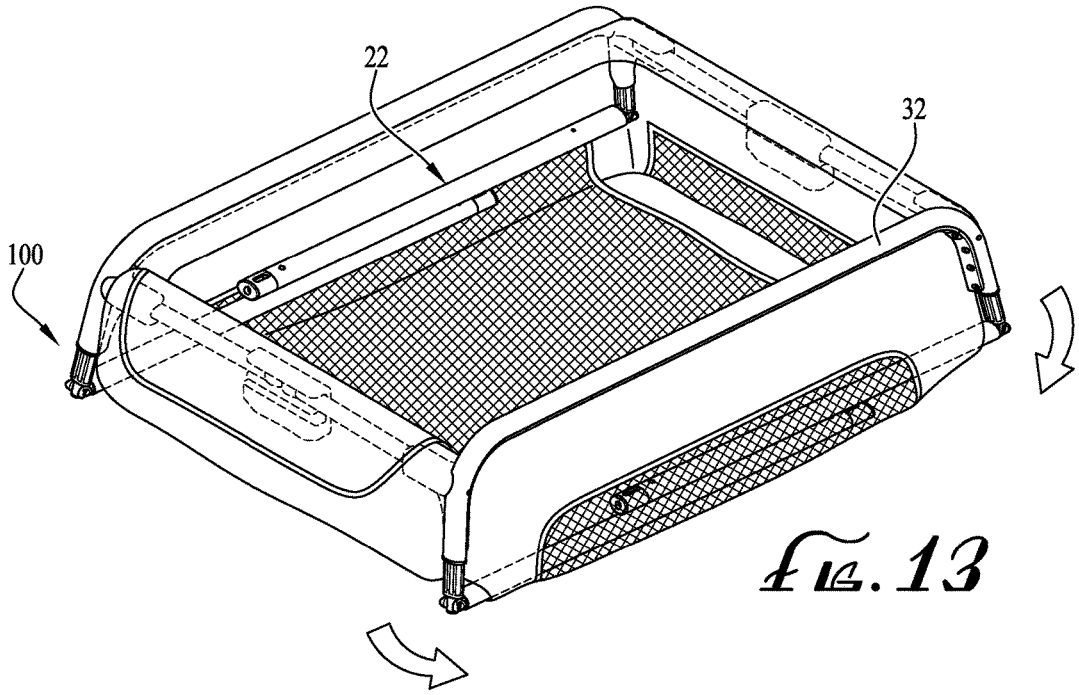
FIG. 13 shows another partially folded configuration of the collapsible play yard, according to a different take-down sequence than shown in FIG. 12.
Figure 14:
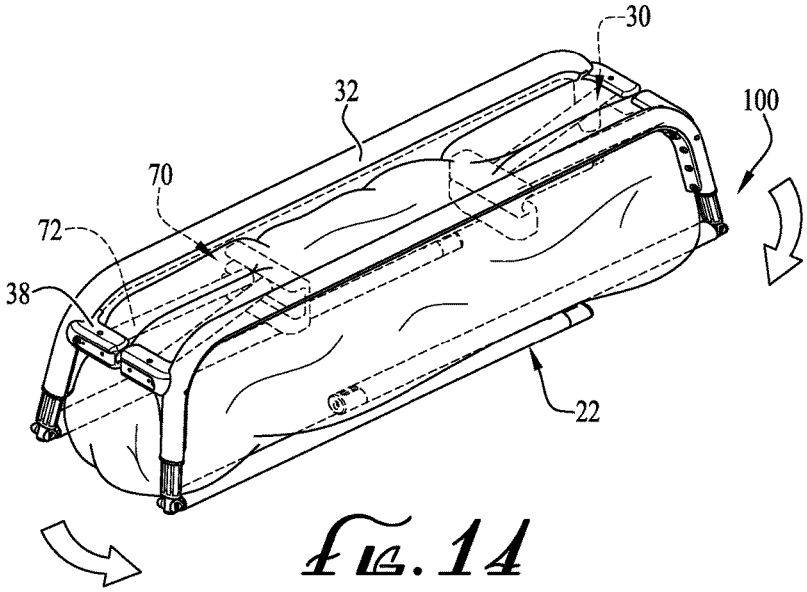
FIG. 14 shows a fully folded configuration of the collapsible play yard.

FIGS. 12-14 show steps in sequences of folding the collapsible play yard 10 into a folded storage and transport configuration. The example embodiment generally includes first folding system 70 that collapses the play yard 10 to a shorter width than its unfolded use configuration, as shown in FIG. 12 and second folding system 100 that collapses the play yard to a shorter height than its unfolded use configuration, as shown in FIG. 13. In the example embodiment of the first folding system 70, shown in FIG. 12, each of the end cross-members 30 includes first and second cross-member segments 72 hingedly connected to one another at the midpoint of each end cross-member. In this embodiment, the attachments 38 between each end of the end cross-member 30 and the side cross-member 32 allow the end cross-member segments 72 to pivot. This configuration allows folding of the end cross-members segments 72 toward one another to reduce the width of the play yard 10, as shown in FIG. 12. In this manner, a user can fold and unfold the play yard 10 between an open or expanded configuration shown in FIG. 5 and a semi-folded configuration shown in FIG. 12. In alternate embodiments the first folding system is positioned on the side cross-members or any location that allows the upper frame to collapse into a shorter width or length.

In the example embodiment of the second folding system 100, shown in FIG. 13, each of the leg members 22 are hingedly connected to the side cross-members 30. This configuration allows folding of each leg member 22 toward the opposite end of the same side cross-member 32 to which it is attached, as shown in FIG. 13. In this manner, a user can fold and unfold the play yard 10 between an open or expanded configuration shown in FIG. 5 and a semi-folded configuration shown in FIG. 13. In alternate embodiments, each leg member 22 folds perpendicular to the side cross-member 32 to which the leg member is connected, toward the center of the play yard, or any direction that shortens the height of the play yard.

FIG. 14 shows the play yard 10 in a full folded configuration, where both the first folding system 70 and the second folding system are engaged 100. The first folding system 70 and second folding system 100 operate independently of one another. When collapsing or expanding the play yard 10, the adult caregiver user can engage either the first folding system 70 or second folding system 100 first: either folding the end cross members 30 first, then the legs 22; or folding the legs first, then the end cross members. Further, the user can store or transport the play yard 10 in the semi-folded configurations of FIGS. 12 and 13 if desired.

Figure 15:
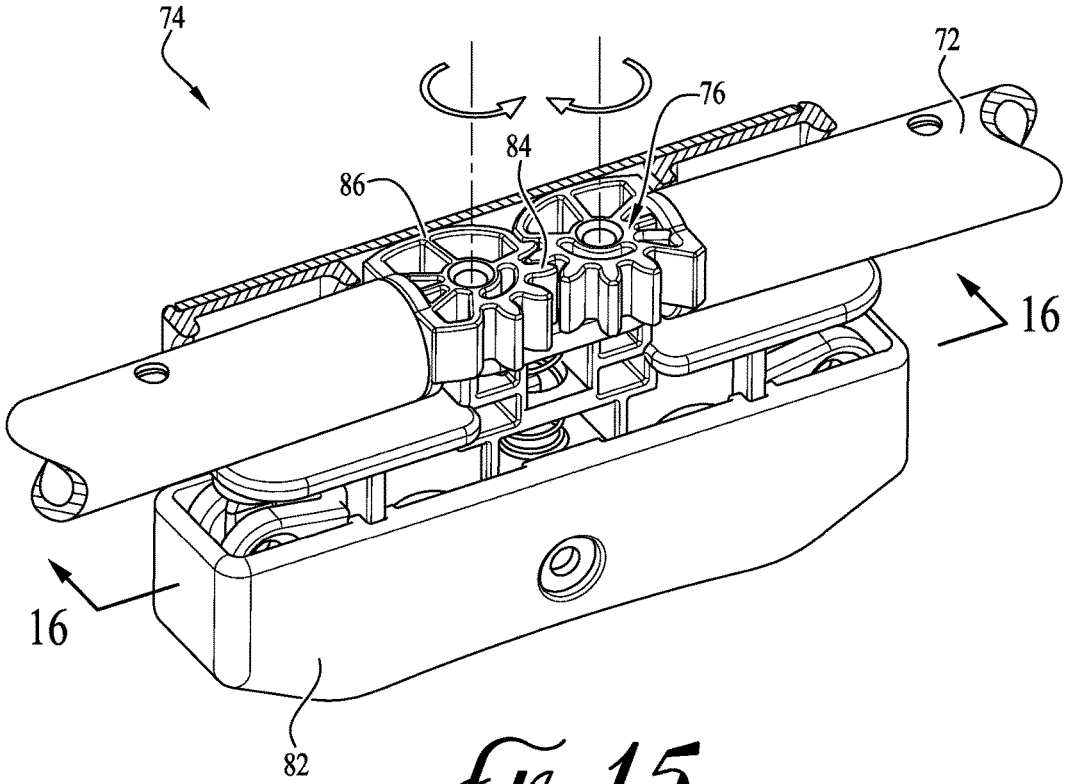
FIG. 15 is a perspective view showing additional detail of a gear hinge for a play yard frame according to an example embodiment of the present invention.
Figure 16:
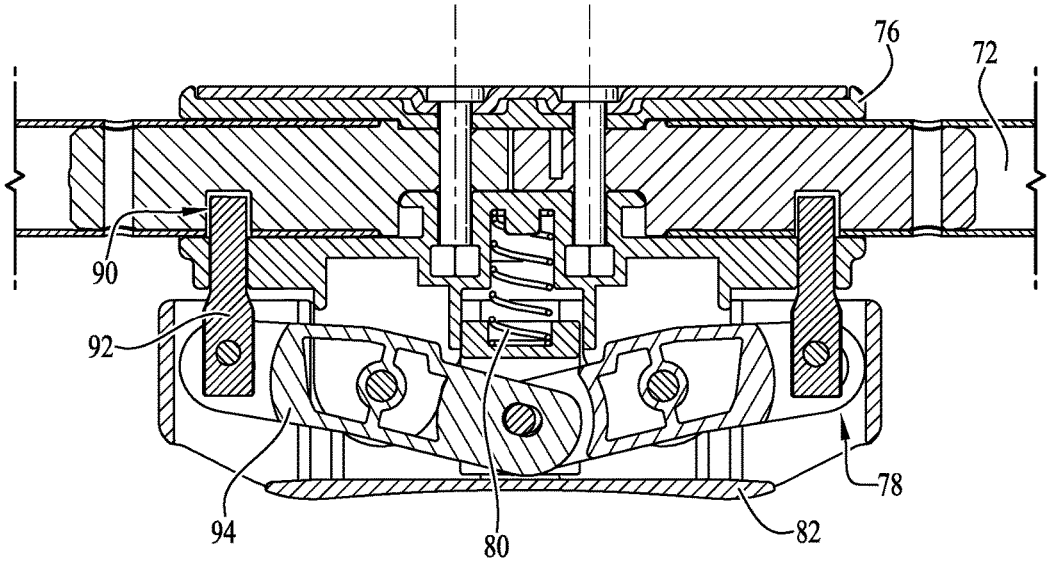
FIG. 16 shows a cross sectional view of the gear hinge of FIG. 15 in a locked position.
Figure 17:
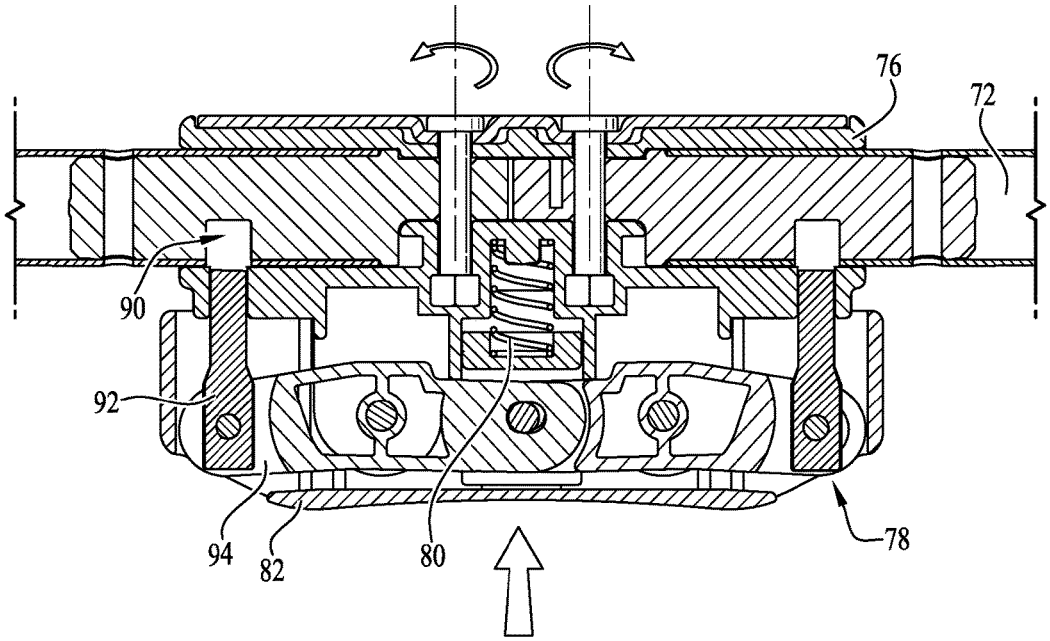
FIG. 17 shows a cross sectional view of the gear hinge of FIG. 15 in an unlocked position.
Figure 18:
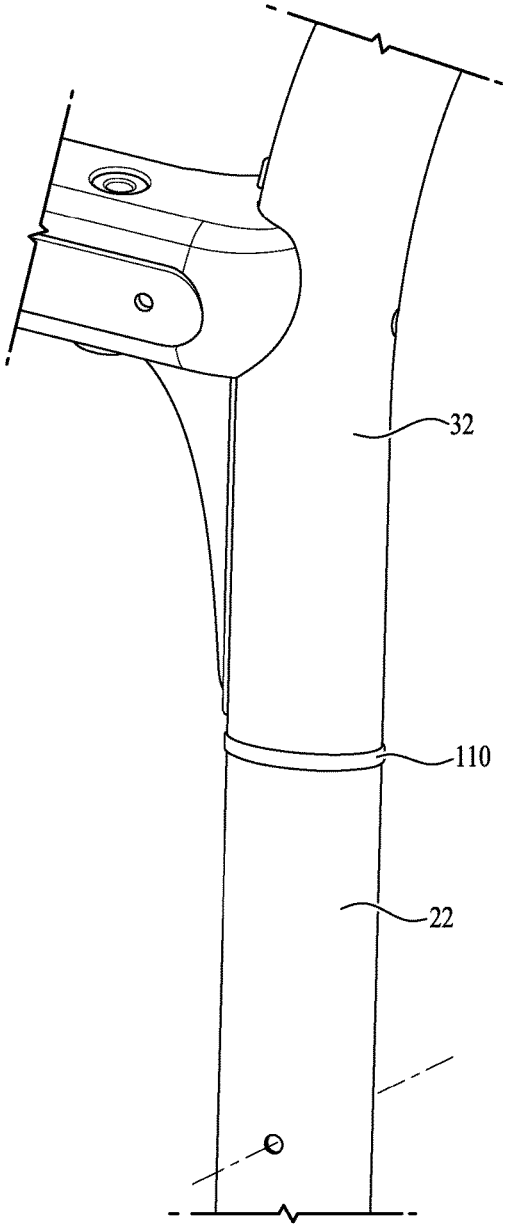
FIG. 18 is a perspective view of a frame joint between a side cross-member and a leg member of a collapsible play yard according to an example embodiment of the present invention.

FIGS. 15-17 show a gear hinge 74 portion of the first folding system 70 according to an example embodiment. The gear hinge 74 includes first and second gears 76 attached to the proximal end of each end cross-member segment 72 of the end cross members 30, first and second locking mechanisms 78, a biasing spring 80 and a handle 82. Each circular gear 76 includes teeth 84 around a hub portion of the gear and a stop surface 86. The teeth 84 of the first gear 76 are positioned to mesh or fit with the teeth of the second gear. The stop surface 86 allows the gear 76 to only pivot in a single direction. Each locking mechanism 78 corresponds to a respective gear. Each locking mechanism 78 includes a slot 90 in the gear configured to receive a locking pin 92 attached to a locking arm 94 that controls the position of the locking pin. In the locked configuration (FIG. 16) the biasing spring 80 biases the locking arms 94 such that the locking pins 92 are held in the slots 90. As shown in FIG. 17, the gear hinge 74 is unlocked by moving the handle 82 toward the gears 76, depressing the biasing spring 80 and pivoting the locking arms 94 such that the lock pins 92 pull out of the slots 90 leaving the hinge 74 free to move.

Figure 19:
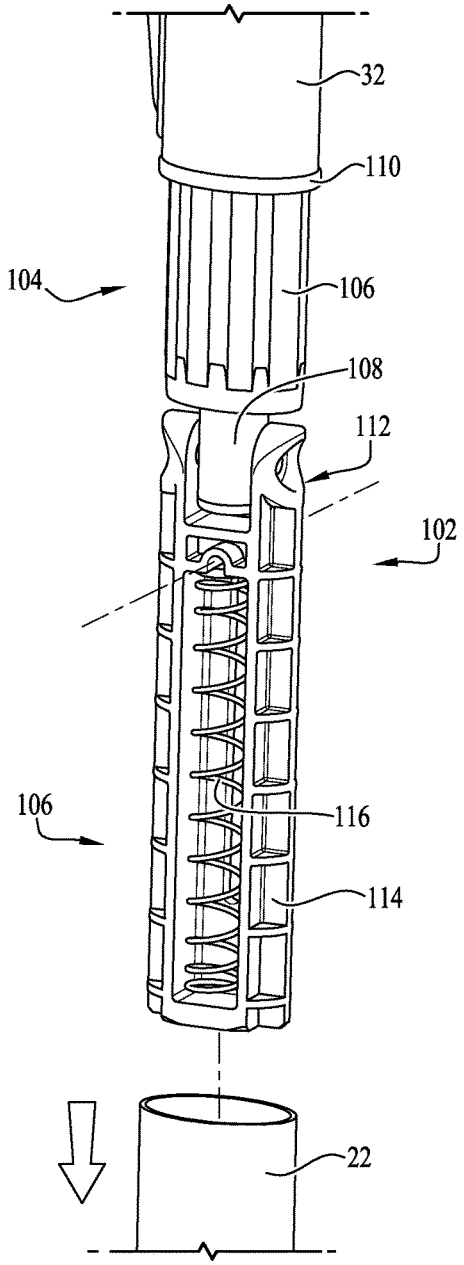
FIG. 19 is an exploded view of a barrel hinge frame component for a play yard according to an example embodiment of the present invention.

FIGS. 18-21 show further details of a barrel hinge 102 component of the second folding system 100 according to an example embodiment. In the depicted embodiment, the barrel hinges attach each leg member 22 to a side cross-member 32. As shown in FIG. 19, each barrel hinge 102 includes an upper portion 104 attached to the side cross-member 32 and a lower portion 106 housed within the leg member 22. The upper portion 104 includes an outer collar 106 and an inner shaft 108 attached within the outer collar. The outer collar 106 has substantially the same cross sectional shape as the side cross-member 32 and is sized to fit within the hollow side cross-member. The outer collar 106 includes a flange 110 extending around the periphery of the outer surface of the collar 106. The flange 110 extends at least as wide as the surface of the side cross-member 32, so that when the collar 106 is inserted into the side cross-member, it cannot be inserted past the flange. The inner shaft 108 is positioned such that a portion of the inner shaft extends beyond the distal end of the outer collar 106. The distal end of the inner shaft 108 is pivotally coupled to the lower portion 106 of the hinge 102. The lower portion 106 includes a coupling portion 112 for receiving and pivotally attaching to the inner shaft 108. Attached to the coupling portion 112 is a housing 114 containing a biasing spring 116.

The housing 114 is shaped to have relatively the same cross section as the leg member 22 and the housing 114 is shaped to fit within the hollow leg member.

Figure 20:
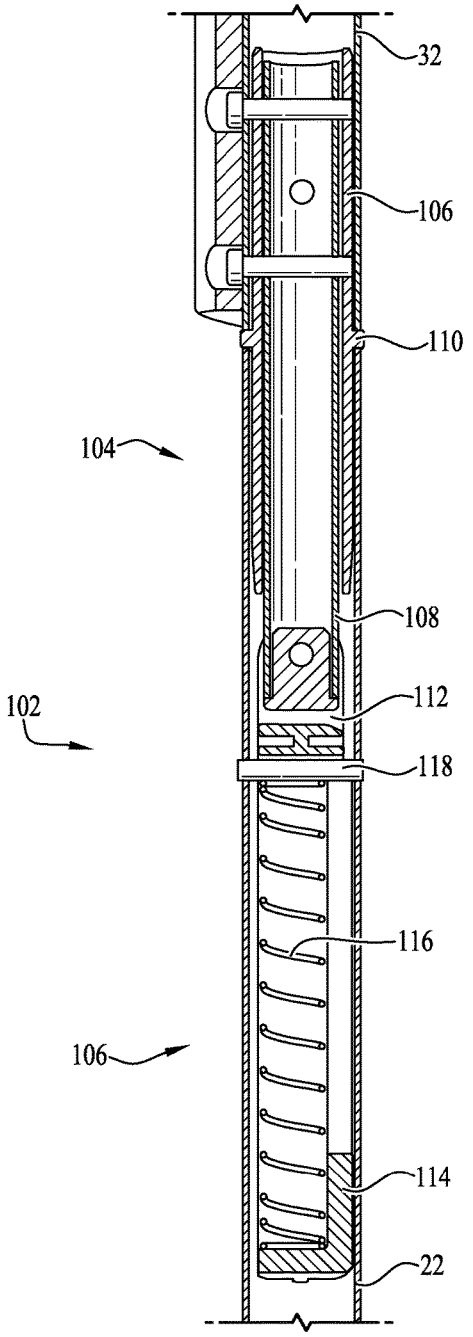
FIG. 20 shows a cross-sectional view of the barrel hinge of FIG. 19 in a locked configuration.
Figure 21:
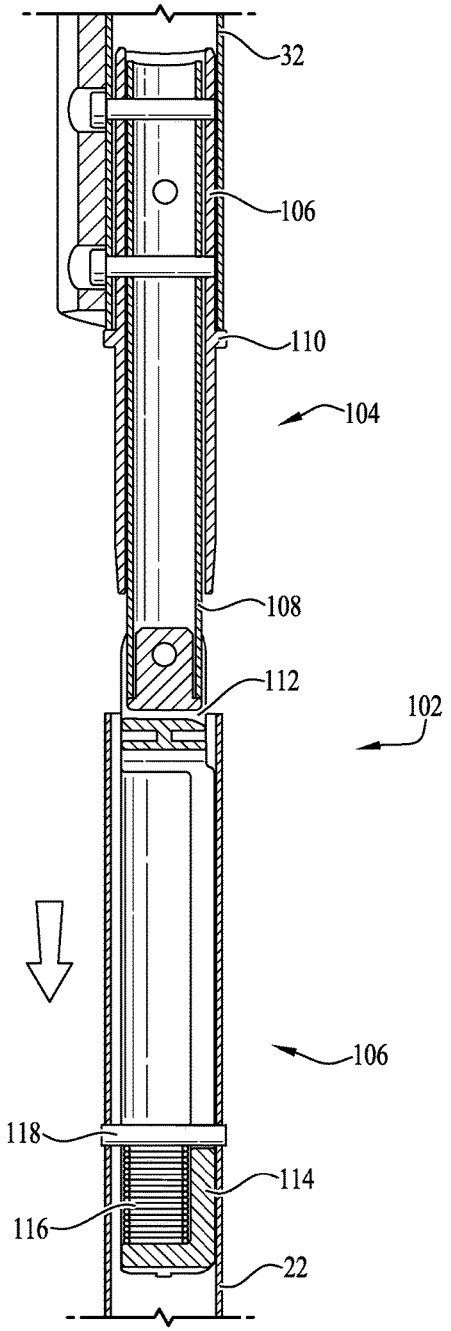
FIG. 21 shows a cross-sectional view of the barrel hinge of FIG. 19 in an unlocked configuration.
Figure 22:
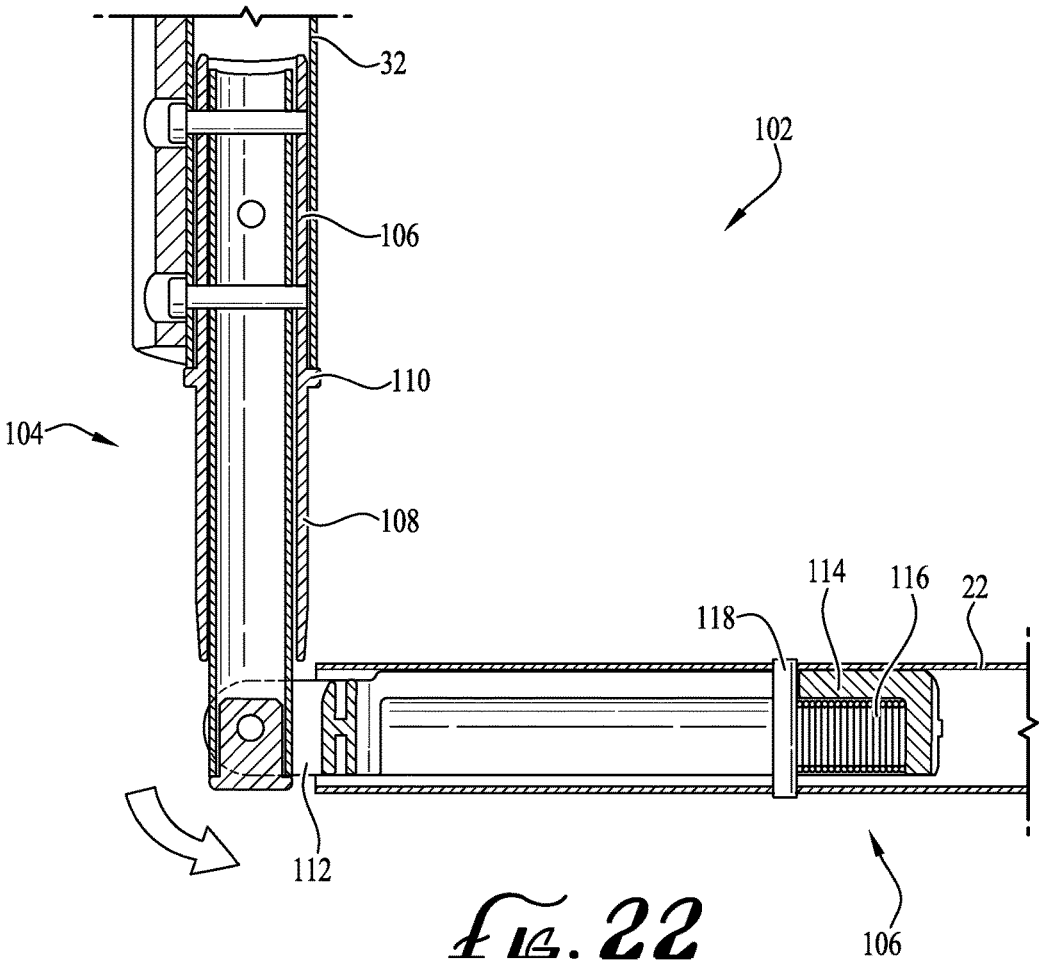
FIG. 22 shows a cross-sectional view of the barrel hinge of FIG. 19 in a folded position.

FIG. 20 shows the barrel hinge 102 within the side cross-member 32 and the leg member 22 in the locked position. The upper portion 104 of the barrel hinge 102 is attached within the side cross-member 32 in a fixed position. The lower portion 106 of the barrel hinge 102 is able to move relative to the leg member 22. The leg member 22 includes a spring pin 118 that is attached at a fixed position within the leg member 22. The spring pin 118 abuts the distal end of the biasing spring 116 such that the spring will be compressed or extended when the lower portion is moved relative to the leg member 22, but the spring pin does not otherwise impede the movement of the lower portion 106 of the barrel hinge 102. In the locked position, the outer surface of the leg member 22 is fitted over the outer collar 106 of the upper portion 102 up to flange 118, which acts as a stop surface. The mating of the leg member 22 and the inserted outer collar 106 covers the hinge and prevents it from pivoting. The biasing spring 116 biases the leg member 22 to this closed or locked position. To open or unlock the barrel hinge 102 a force is applied to pull the leg member 22 and side cross-member 32 away from each other, compressing the biasing spring 116. The leg member 22 is moved off of the outer collar 106 and past the internal shaft 108 to where the hinge portion 112 is exposed, as depicted in FIG. 21. With the hinge portion 112 exposed, the leg member 22 can be pivoted to a folded position, as shown in FIG. 22. To return the leg member 22 to its use position, the leg member is folded back to the position depicted in FIG. 21 and the leg member is fitted over the outer collar 106 as shown in FIG. 20.

Figure 23:
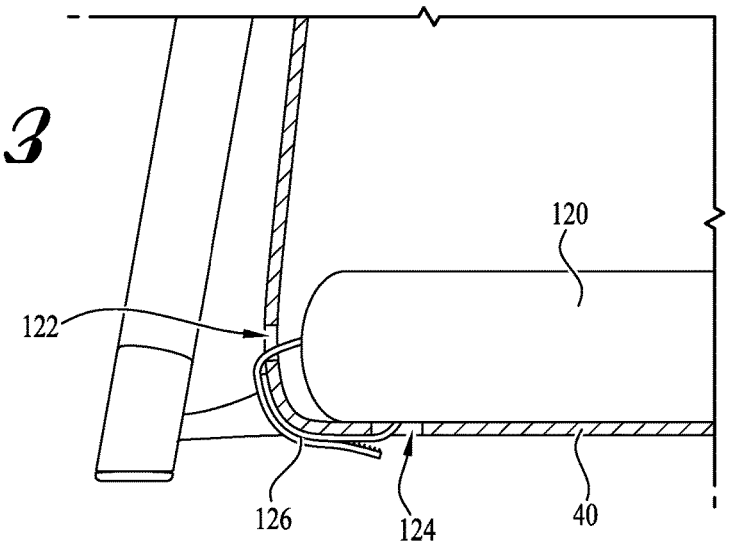
FIG. 23 shows a cross-sectional view of a liner and mattress portions of a collapsible play yard according to an example embodiment of the present invention.

A floor platform or mattress 120 is optionally provided for placement on the floor panel 42 within the liner 40 and may for example comprise a plurality of foldable segments optionally with internal cushioning or support. In the depicted embodiments, the floor panel 40 and mattress 120 rest on the floor or other support surface S. In alternate embodiments, the floor panel and mattress are suspended above the support surface. The mattress 120 can optionally include anchor straps 126, as shown in FIG. 23, to help hold the mattress in position relative to the liner 40. In the depicted embodiment, the liner 40 includes a pair of holes 122, 124, one in the floor panel 124 and one in either the side wall or end wall 122. In alternate embodiments, the holes 122, 124 may be otherwise positioned. The anchor strap 126 goes through one hole 122 to outside the liner then back into the liner through the second hole 124 to reattach to the mattress 120. Alternatively, the strap 126 goes through an opening in the liner 40 and attaches to the outside of the liner or to the frame 20, or straps 126 or other portion of the mattress 120 attach to inside portions of the liner 40. The anchor strap 126 or other portion of the mattress 120 can be secured to the liner 40 or secured elsewhere by hook-and-loop attachment material, zipper, snaps, buttons, ties, buckles or other attachment means.

Figure 24:
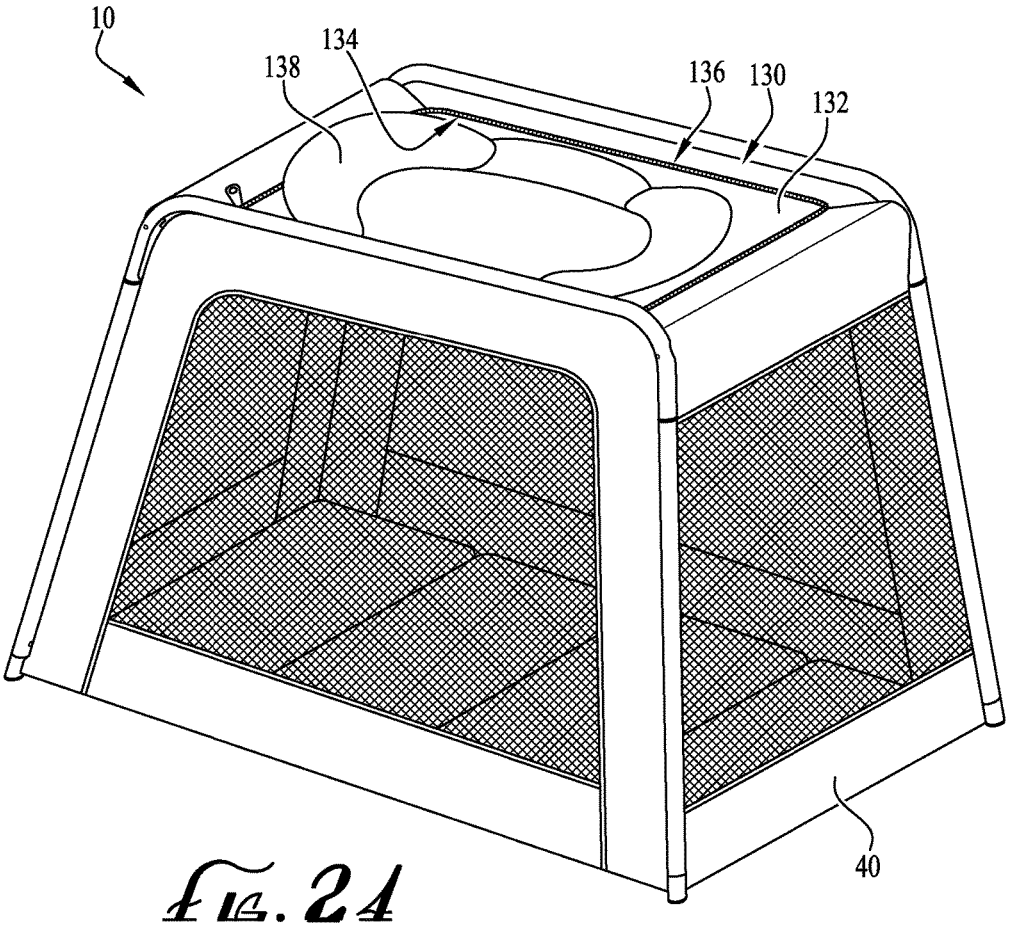
FIG. 24 is a perspective view of a collapsible play yard and inclined sleeper according to an example embodiment of the present invention.

The play yard 10 optionally further includes one or more detachable accessories, such as for example a bassinet or inclined sleeper 130 as depicted in FIG. 24. The inclined sleeper 130 is secured within the top of the contained space of the play yard 10, with an attachment mechanism for attachment to the frame 20 and/or the liner 40, for example a zipper, hooks, clips or other fastener(s). In the depicted embodiment, the inclined sleeper 130 includes an inclinable flap 132 and the inclinable flap includes a row of zipper 134 teeth along a portion of the perimeter of the inclined flap. The adjacent side walls of the play yard liner 40 include a corresponding row of zipper teeth 136 between an upper and lower perimeter of the side and end walls. The row of zipper teeth 136 is disposed along an inclined path relative to the support surface S. The inclined flap 132 includes soft goods 138 configured to support and retain an infant or child. In alternate embodiments, other fastening mechanisms can be used.

In example modes of use, an adult caregiver user of the play yard device 10 attaches the liner 40 to the frame 20 by engagement of the liner attachment assembly according to any of the above described embodiments. Alternatively, the liner 40 is pre-assembled with the frame 20, and may be removable by the end user or permanently attached. The user erects the play yard 10 by unfolding the frame in any sequence, as described above, positions the lower ends of the legs 22 of the frame on the floor or other support surface, which expands the liner to surround the enclosed space of the play yard. A child may then be placed into the play yard 10, for example over the end sidewall 46 at the lower front elevation FE for improved ease of accessibility. The inclined top of the play yard allows improved visibility into the contained space of the play yard, for increased interaction between a child in the play yard and a caregiver outside of the play yard. If desired, one or more accessories, such as a bassinet 130 are optionally installed into or onto the play yard 10. After use, the child is removed from the play yard 10, and the play yard may be folded as described above, from its expanded or use configuration (FIG. 5) to a compact folded configuration (FIGS. 12-14) for transport and storage.

While the invention has been described with reference to example embodiments, it will be understood by those skilled in the art that a variety of modifications, additions and deletions are within the scope of the invention, as defined by the following claims.

What is claimed is:

1. A collapsible play yard for containing a child, the collapsible play yard comprising:

a frame having a smaller upper periphery than base periphery, the frame configured for supporting the play yard upon a surface, the frame comprising first and second sides each comprising an upper frame member and a front leg and a back leg, the front and back legs having distal ends for resting on the surface, with the front legs being shorter than the back legs so that a top portion of the frame is upwardly inclined from front to back when the frame rests upon the surface, and wherein the periphery of the distal ends the front and back legs extend out beyond the periphery of the top portion; and a liner attached to and supported by the frame, the liner being adapted for supporting and containing a child and having a floor panel, first and second side wall panels, and first and second end wall panels, with the panels connected to one another, and wherein with the frame resting upon the surface, the floor panel of the liner is held substantially parallel to the surface.

2. The collapsible play yard of claim 1, wherein the front and back legs of the frame are splayed outwardly from top to bottom with the frame resting upon the surface.

3. The collapsible play yard of claim 2, wherein the frame defines a three-dimensional assembly having a relatively larger base periphery defined by the lower ends of the support legs and a relatively smaller upper periphery defined by the top portion of the frame.

4. The collapsible play yard of claim 1, further comprising a mattress configured for removable placement within the collapsible play yard and supported by the floor panel.

5. The collapsible play yard of claim 1, wherein the frame is collapsible between an upright use configuration and a compact folded configuration.

6. The collapsible play yard of claim 5, wherein the frame comprises a pair of end cross members and a pair of side cross members, and wherein each of the pair of end cross members is independently foldable, and wherein the legs are foldable relative to the side cross members.

7. The collapsible play yard of claim 6, wherein the frame is collapsible regardless of the order of folding the end cross members and the legs.

8. The collapsible play yard of claim 1, further comprising a liner attachment assembly for attaching the liner to the frame, the liner attachment assembly comprising a liner coupling member having a female channel and a male liner attachment rod configured for engagement within the female channel.

9. The collapsible play yard of claim 1, wherein the frame comprises frame members which have an elliptical cross-sectional shape.

10. The collapsible play yard of claim 1, further comprising a child sleeper accessory configured for removable attachment to the liner or the frame.

11. A collapsible play yard comprising:

a hollow frame comprising a plurality of support legs, each support leg having an upper end and a lower end, and a plurality of frame cross members extending between upper ends of the support legs, wherein the frame defines a three-dimensional assembly having a relatively larger base periphery defined by the lower ends of the support legs and a relatively smaller upper periphery defined by the frame cross members;

a first folding system for folding at least one cross member and a second folding system for folding at least one support leg, wherein the first folding system and the second folding system operate independently of one another, and wherein the second folding system for folding at least one support leg comprises a retractable and extendable hinge which can be retracted into a frame cross member and restrains the support leg from pivotal movement and can be extended relative to the frame cross member to permit pivotal movement of the support leg relative to the frame cross member; and a liner attached to and supported by the frame, the liner being adapted for supporting and containing a child and having a floor panel, first and second side panels, and first and second end panels, with the panels connected to one another, and wherein with the frame resting upon the surface, the floor panel of the liner is held substantially parallel to the surface.

12. The collapsible play yard of claim 11, further comprising a mattress configured for removable placement within the collapsible play yard and supported by the floor panel.

13. The collapsible play yard of claim 11, further comprising a child sleeper accessory configured for removable attachment to the liner or the frame.

14. The collapsible play yard of claim 11, wherein the lower ends of the support legs are not connected to one another.

15. The collapsible play yard of claim 11, wherein a front end of the child containment device has a front elevation, and a back end of the child containment device has a back elevation, the back elevation being greater than the front elevation.

16. The collapsible play yard of claim 11, wherein the frame is collapsible between an upright use configuration and a compact folded configuration.

17. The collapsible play yard of claim 16, wherein the frame cross members comprise a pair of end cross members and a pair of side cross members, and wherein each of the pair of end cross members is foldable, and wherein the support legs are foldable relative to the side cross members.

18. The collapsible play yard of claim 17, wherein the frame is collapsible regardless of the order of folding the end cross members and the support legs.

19. The collapsible play yard of claim 11, further comprising a liner attachment assembly for attaching the liner to the frame, the liner attachment assembly comprising a female liner coupling defining a channel and a male liner attachment rod configured for engagement within the channel of the female liner coupling.

20. The collapsible play yard of claim 11, wherein the frame comprises frame members which have an elliptical cross-sectional shape.

* * * * *